US006668767B1

(12) United States Patent
Sánchez Talero et al.

(10) Patent No.: US 6,668,767 B1
(45) Date of Patent: Dec. 30, 2003

(54) INTERNAL COMBUSTION ENGINE ROTATORY (TURBOVOLANTE)

(76) Inventors: John Alejandro Sánchez Talero, Clle 8# 26-64, Bogota (CO); Augusto Sánchez Medina, Clle 8# 26-64, Bogota (CO)

( * ) Notice: Subject to any disclaimer, the term of this patent is extended or adjusted under 35 U.S.C. 154(b) by 0 days.

(21) Appl. No.: 09/633,623

(22) Filed: Aug. 7, 2000

(30) Foreign Application Priority Data

Sep. 8, 1999 (CO) ..... 9956673

(51) Int. Cl.[7] ..... F02B 57/00; F02B 53/00
(52) U.S. Cl. ..... 123/43 R; 123/241; 123/18 R
(58) Field of Search ..... 123/241, 43 R, 123/18 R, 222, 227

(56) References Cited

U.S. PATENT DOCUMENTS

| | | | | | |
|---|---|---|---|---|---|
| 1,349,353 | A | * | 8/1920 | Wilber, Jr. | 123/227 |
| 1,790,256 | A | * | 1/1931 | Wright | 123/227 |
| 2,938,505 | A | * | 5/1960 | Quartier | 123/222 |
| 3,320,936 | A | * | 5/1967 | Phalen et al. | 123/43 R |
| 3,364,908 | A | * | 1/1968 | Herpolsheimer | 123/241 |
| 3,438,358 | A | * | 4/1969 | Porsch et al. | 123/241 |
| 3,855,977 | A | * | 12/1974 | Statkus | 123/43 R |
| 3,871,337 | A | * | 3/1975 | Green et al. | 123/241 |
| 4,072,132 | A | * | 2/1978 | Lindros | 123/241 |
| 5,660,399 | A | * | 8/1997 | Atmur et al. | 277/223 |

FOREIGN PATENT DOCUMENTS

| | | | | |
|---|---|---|---|---|
| CA | 1155064 A | * | 10/1983 | 123/43 R |
| DE | 2 319 257 | * | 10/1974 | |
| DE | 42 25 932 A1 | * | 2/1994 | 123/241 |
| FR | 2 651 828 | * | 3/1991 | 123/43 R |

* cited by examiner

*Primary Examiner*—Thomas Denion
*Assistant Examiner*—Thai-Ba Trieu
(74) *Attorney, Agent, or Firm*—Kramer & Amado, P.C.

(57) ABSTRACT

A rotary engine having at least two piston blades that may be actuated by either internal combustion or electromagnetic actuation. The combustion engine includes piston blades having a toothed moving pinion connected to each piston blade and a toothed fixed pinion geared to the toothed moving pinions. The gear ratio of the toothed fixed pinion to the toothed moving pinions is one half the number of piston blades to one.

14 Claims, 9 Drawing Sheets

INTERNAL COMBUSTION ENGINE ROTATORY (TURBOVOLANTE)

BACKGROUND OF THE INVENTION

In mechanical energy production through internal combustion motors, several different engines have been developed featured by carrying out 4 basic functions or strokes: admission, compression, explosion and exhaust. This type of engine was the invention of August Otto and has been subsequently the subject of several changes. Its basic principles remaining unchanged; these gave rise to engines having 4-valves per piston, 2 sparkplugs per piston, engines with cylinders in line or in V, engines carrying out the 4 functions or strokes in two turns of the piston crankshaft, the so-called 2-stroke engine; also there are engines with pistons divided around a crankshaft, mostly used in aviation, the toric engine as well as others. The Wankel engine at one thee was considered the potential definite substitute of the traditional Otto piston engine, but due to higher fuel consumption, in relation to the traditional engine, forced the idea to be abandoned. There is also the engine that due to over-compression explodes its mixture, such as Diesel engine, and there exist other power plants that have not been proven a challenge to the Otto engine. At present, auto manufacturers and others, are looking for other options to substitute internal combustion engines, for example, electric engines.

SUMMARY OF THE INVENTION

An object of the invention is to use 4 basic strokes: admission, compression, explosion and exhaust, to manufacture a new internal combustion motor plant, characterized by its ability to produce energy within rectangular chambers inside a circular device, whereby the 4 strokes are carried out using rectangular piston blades pivoting at one end and transmitting power through the other end of the piston blades to the pinions via the connecting rods and the crankshafts. These moving pinions, that according to their movement push the rotor, actuate through a gear a fixed pinion or a fixed interior toothed-ring, allowing it to begin a new cycle once a cycle has ended.

In one embodiment of the engine having 4-piston blades, it has the ability to repeat the cycle of admission, compression, and explosion and exhaust cycle once each revolution or turn of the engine, and in the embodiment having 8-piston blades, twice each revolution or turn of the engine. That is, either the pinions traveling across an internal fixed toothed-ring or encircling a fixed pinion with the same relation, 2:1 for the 4-piston blade engine, 4:1 for the 8-piston blade engine and 6:1 for 12-piston blade engine embodiment.

The present invention further relies on a lubrication system where oil comes into through the central portion of the engine by means of a mechanical seal with holes and slots and is evacuated through seals along the periphery of the rotor.

The present invention further includes an air-cooling system, located in the sides or the rotor, provided with turbines allowing for air to pass from one side of the rotor to the other by means of chambers in the fixed portion of the stator. The lubrication system also helps in the cooling due to the hot oil evacuated from the engine passes through a radiator. The engine seals or gaskets are similar to those of the Wankel engine, these seals lowering friction both in the chambers as in the rotor.

The present invention, additionally, is provided with a reinforcing system or additional aid to piston blade displacement by explosion through polarization of the piston blades with positive or negative magnetic charges which are repel or repulsed with its stator, when piston blades are nearer the stator with the same type of positive or negative magnetic charge. The charge of the electromagnet of the stator is increased at the moment that it passes a few degrees from its maximum position through the load yielded by the alternator or dynamo, which is synchronized and distributed by means of timers, electronic panels, thus further lowering fuel consumption.

DETAILED DESCRIPTION OF THE INVENTION

Figure 1:
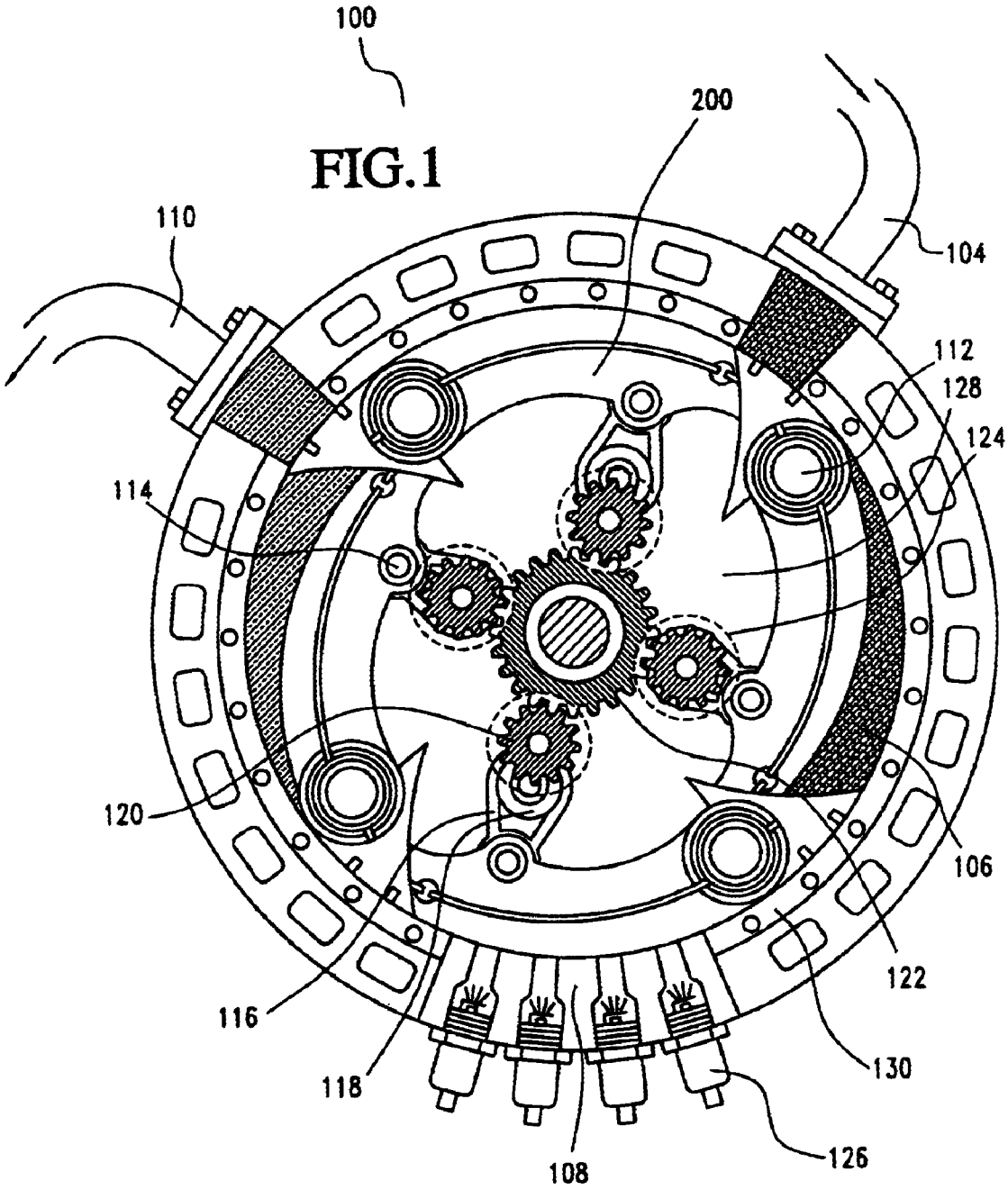
FIG. 1 shows a schematic side view of a rotary internal combustion engine.

FIG. 1 shows a rotary internal combustion engine 100, where curved rectangular piston blades 200 realize the four strokes: admission 104, compression 106, explosion 108 and exhaust 110. The piston blades are supported at a proximal end 112 while the distal end 114 is transported due to explosion 108 pushing a connecting rod 116 which moves a crankshaft 118 making the pinion 120 rotate, which when supported on the fixed pinion 122 rotates twice per rotation, pushing and making the rotor spin through the bearings 124 which are embedded between rotor lids (not shown), between the crankshaft 118 and the pinion 120 of each piston blade 200; the explosion 108 being carried out by 8 sparkplugs 126 arranged in two rows of four sparkplugs 126. Four curved divided seals (not shown), located in each side over the periphery of the rotor 128 are supported and produce a tight seal with the stator 130.

Figure 2:
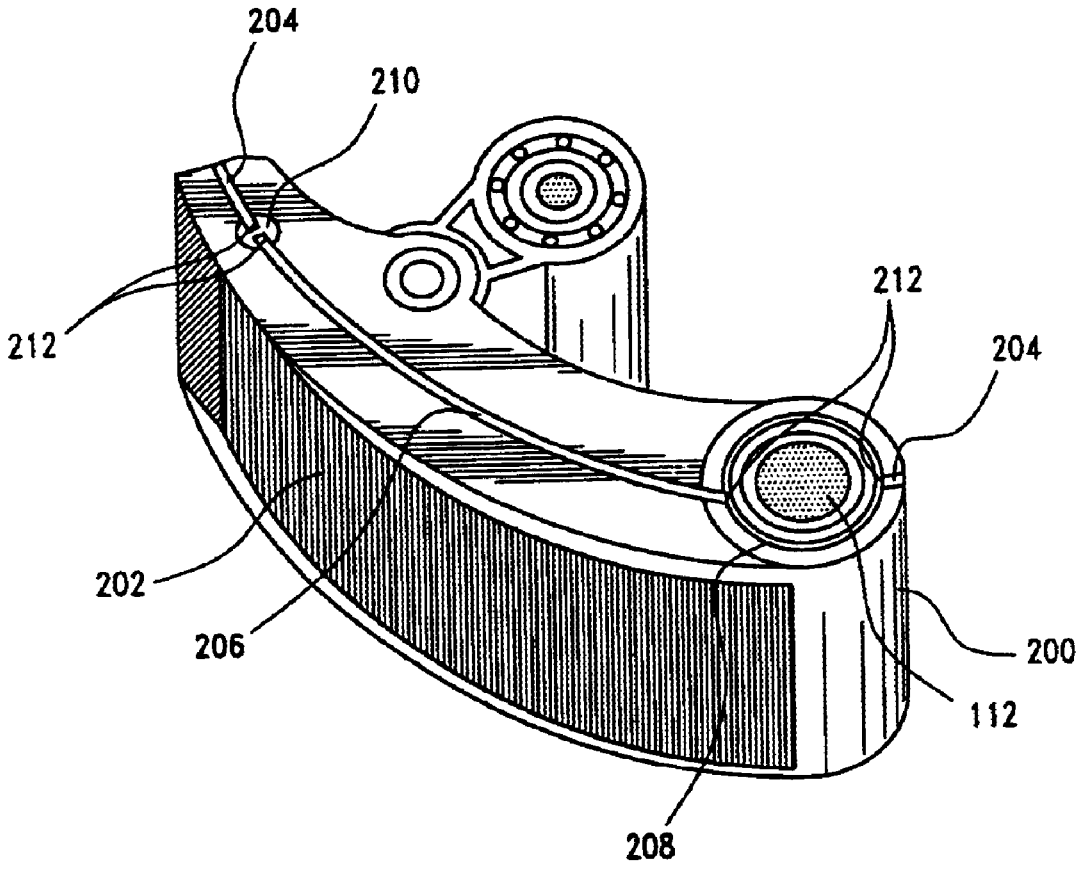
FIG. 2 shows one of the curved rectangular piston blades along with the respective seals.

FIG. 2 shows a curved rectangular piston blade 200 with a cavity 202 at its base, in proportion to the compression necessary, ranging from 1:1 to 1:15. Also a system of seals is shown, including edge seals 204, central linear seal 206 and circular seal 208 around the proximal end 112. In this circular seal 208 and plug seal 210 there are small boxes 212 wherein the ends of edge seals 204 and central linear seals 206 enter, thus gaining a perfect seal for the fin 200 and its chamber is completely sealed in any position.

Figure 3:
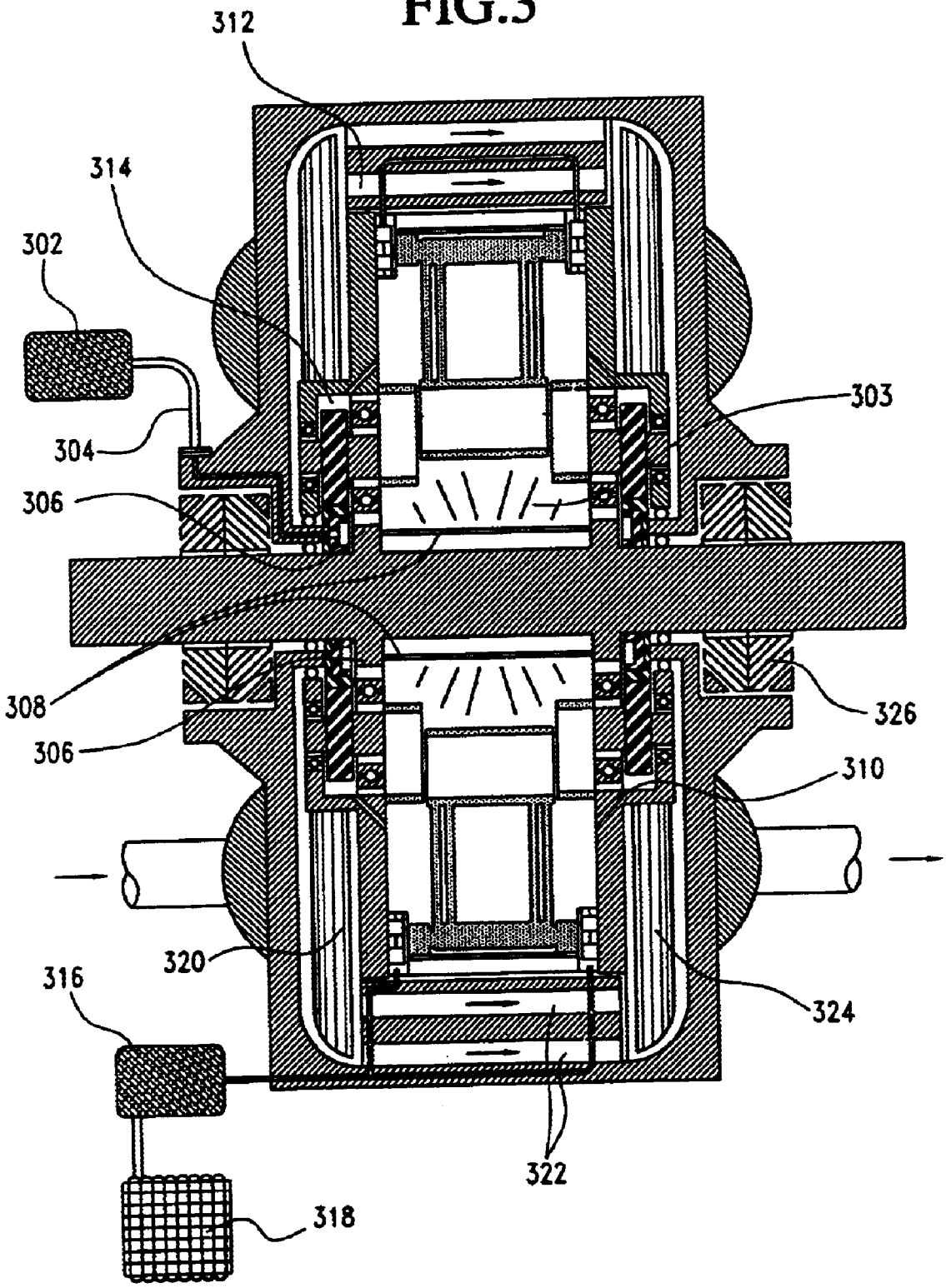
FIG. 3 shows a front view of a 4-piston blade rotary internal combustion engine.

FIG. 3, along with references to FIG. 1, show how lubrication and cooling takes place. Lubrication takes place by oil 302 going into the engine through external ducts 304. The engine has a drilled seal with a ring-shaped slot 306 allowing for oil 302 to enter into the inside of the rotor 128 through 4 drilled pipes 308 distributed one per chamber that permanently sprays oil 303 in those areas requiring lubrication and various internal ducts 310 lead pinion lubrication oil to the piston blades 200 Slots 314 located along the length of peripheral seals 312 allow for the evacuation of oil 302, which pass across slots and ducts (not shown) with the aid of an oil pump. To enhance cooling, hot oil 302 passes through a radiator 318. The cooling system operates through the air taken in, and sent by turbine 320 from one side of the rotor 128 to the other side, through stator cavernous body 322 where it is received at the other end by a second turbine 324, which suctions and expels air allowing the suctioning of air, both for admission and for conditioning of the air. The rotor 128 is supported by dual-stoke rolls 326, which function either horizontally or vertically. These cooling and lubrication systems operate both in the engine shown in FIG. 1 and FIG. 4.

Figure 4:
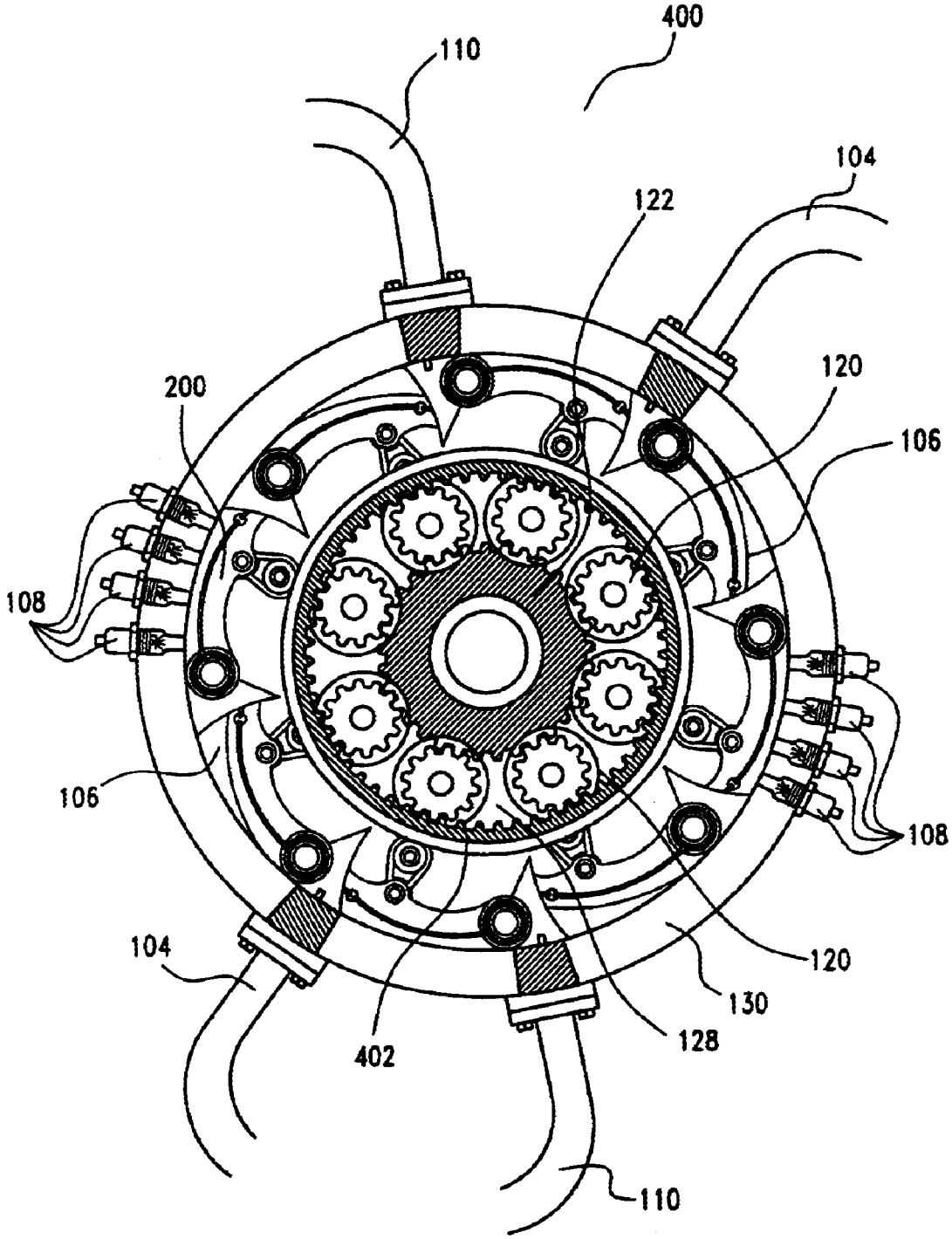
FIG. 4 shows a side view of an 8-piston blade rotary internal combustion engine.

FIG. 4 shows a rotary internal combustion engine 400 having eight curved and rectangular piston blades 200, wherein one revolution of the rotor 128 in the stator 130, requires four revolutions of the pinions 120 inside the fixed internally-toothed ring 402 or the fixed pinion 122, thereby requiring four turns per revolution and 2 piston blade 200 cycles per turn, that is, twice admission 104, compression 106, explosion 108, exhaust 110. This engine differs from the engine of four chambers shown in FIG. 1, in that the engine of FIG. 1 has four chambers, four connecting rods 116, four crankshafts 118 and four pinions 120. Also, related to the four chamber engine, the pinions 120 are supported either in the fixed internally-toothed ring 402 or in the fixed pinion 122. The rotary internal combustion engine 400 lowers rotor 128 velocity relative to that in FIG. 1, but with increased power.

Figure 5:
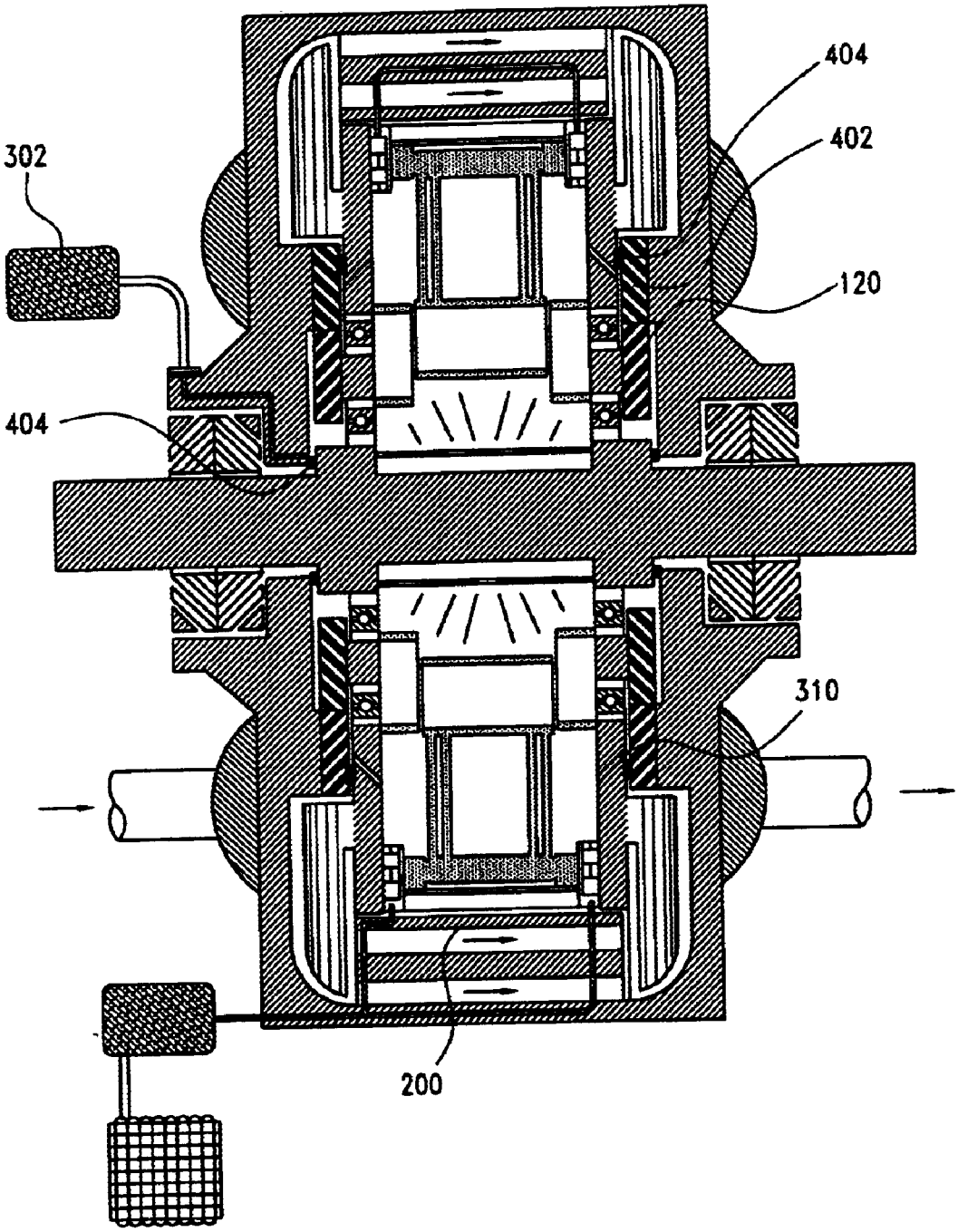
FIG. 5 shows a front view of an 8-piston blade rotary internal combustion engine.

FIG. 5 shows a rotary internal combustion engine 400 in a front view having eight curved and rectangular piston blades 200. The engines major feature is the way pinions 120 are geared in the fixed internally-toothed ring 402 with a 4:1 ratio. It is outfitted with mechanical seals 404 keeping oil 302 from coming out when entering through mechanical seals 404 and passes from pinions 120 to piston blades 200 by means of internal ducts 310 distributing and expelling oil 303 through the same systems displayed in FIG. 3.

Figure 6:
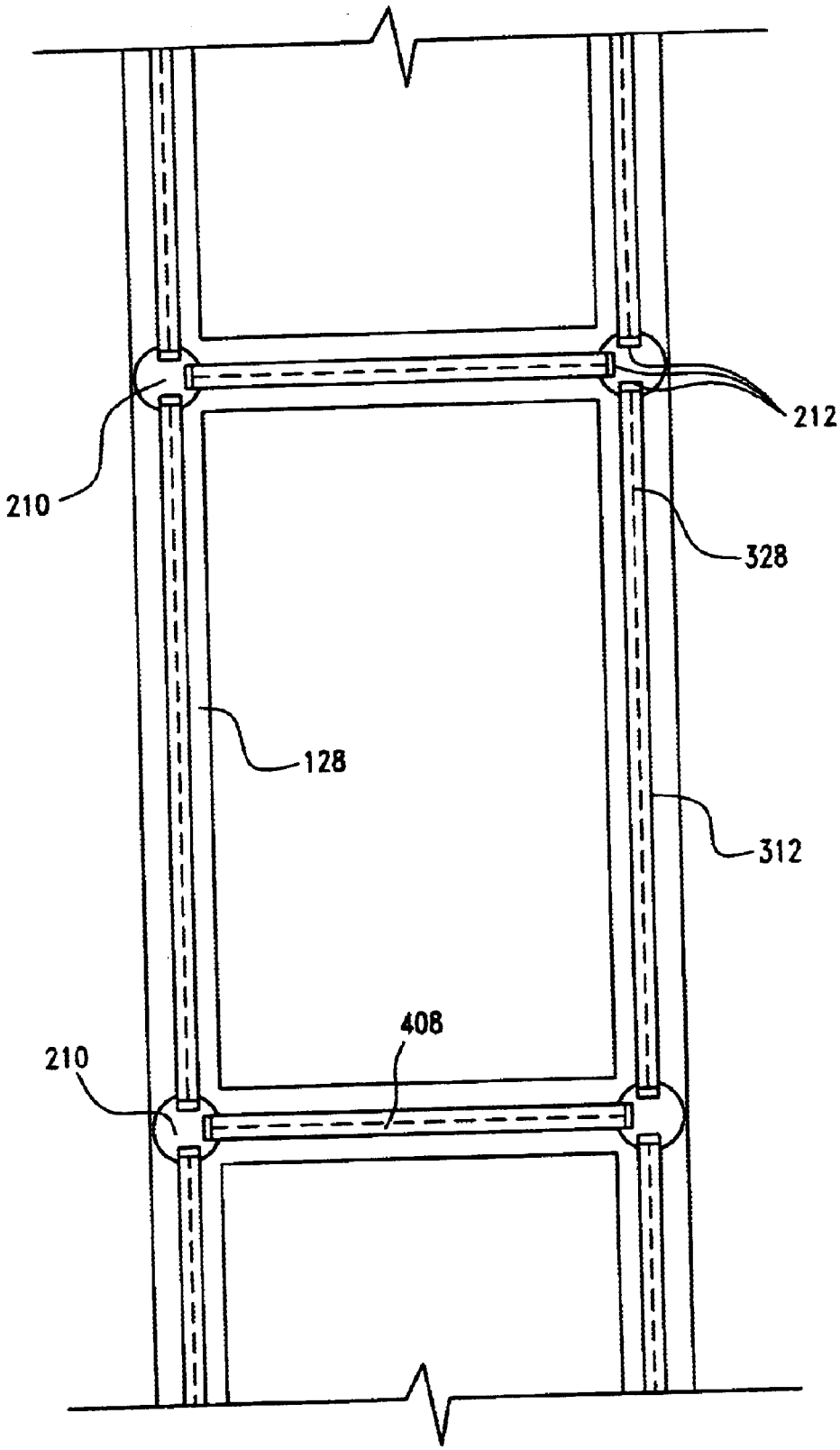
FIG. 6 shows a front view of the rotor surface with seals.

FIG. 6 shows a portion of the rotor surface 128where one can see how peripheral seals 312 are arranged with longitudinal holes 328, these seals and the transverse seals 408 are aligned at their ends by means of plug seals 210, which have seal boxes 212 that tightly align with the seals and thus achieving a perfect seal with minimum friction.

Figure 7:
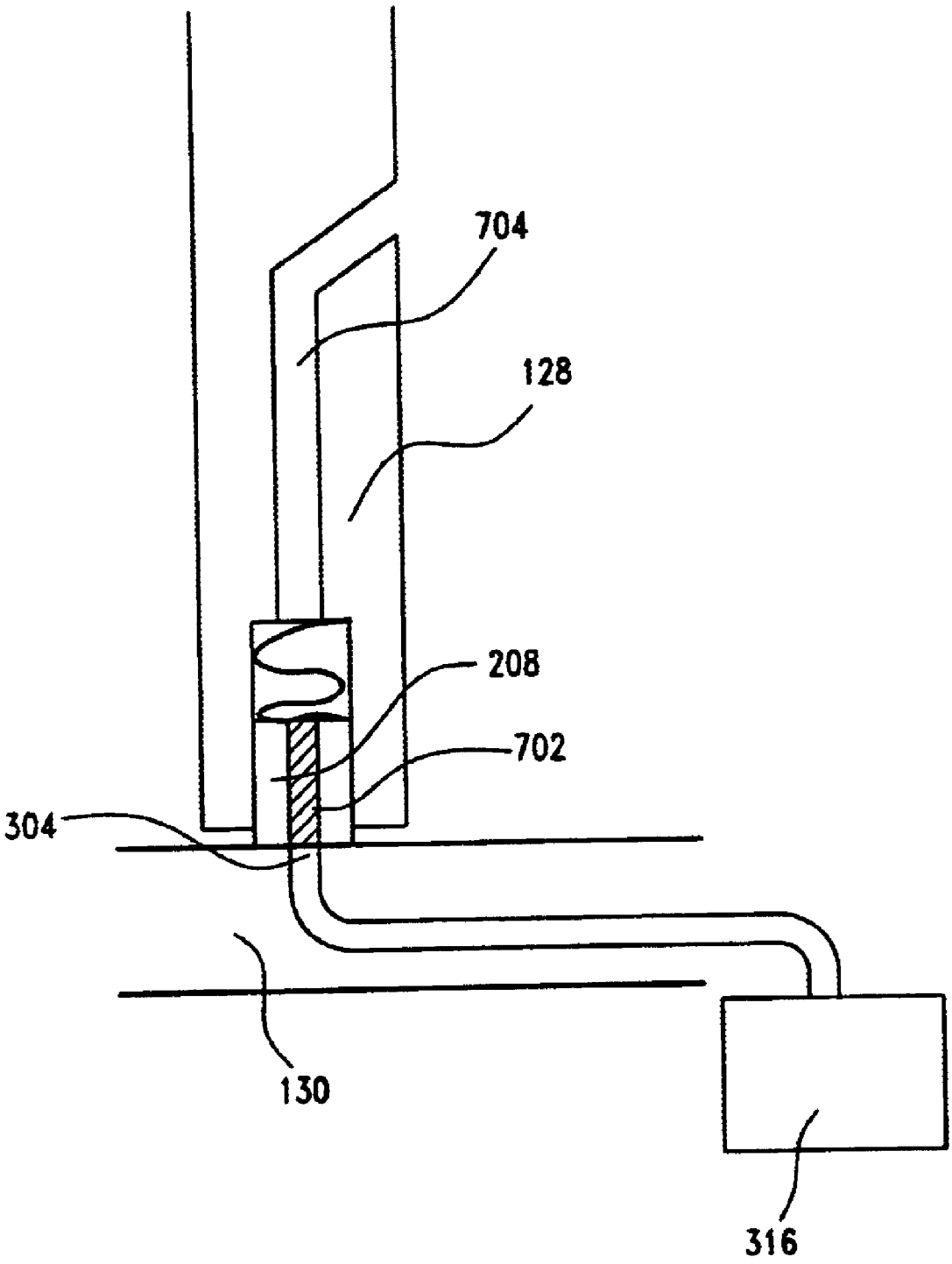
FIG. 7 shows a side view of the rotor peripheral seal with the stator and air outlet device.

FIG. 7 shows a cross-sectional rotor 128 and its circular seal 208 located between rotor 128 and stator 130. This seal is provided with longitudinal slots 702 disposed along the external duct 304, and allowing for the oil 302 to be evacuated through the expulsion cavity 704 by means of the oil pump 316 and centrifugal force.

Figure 8:
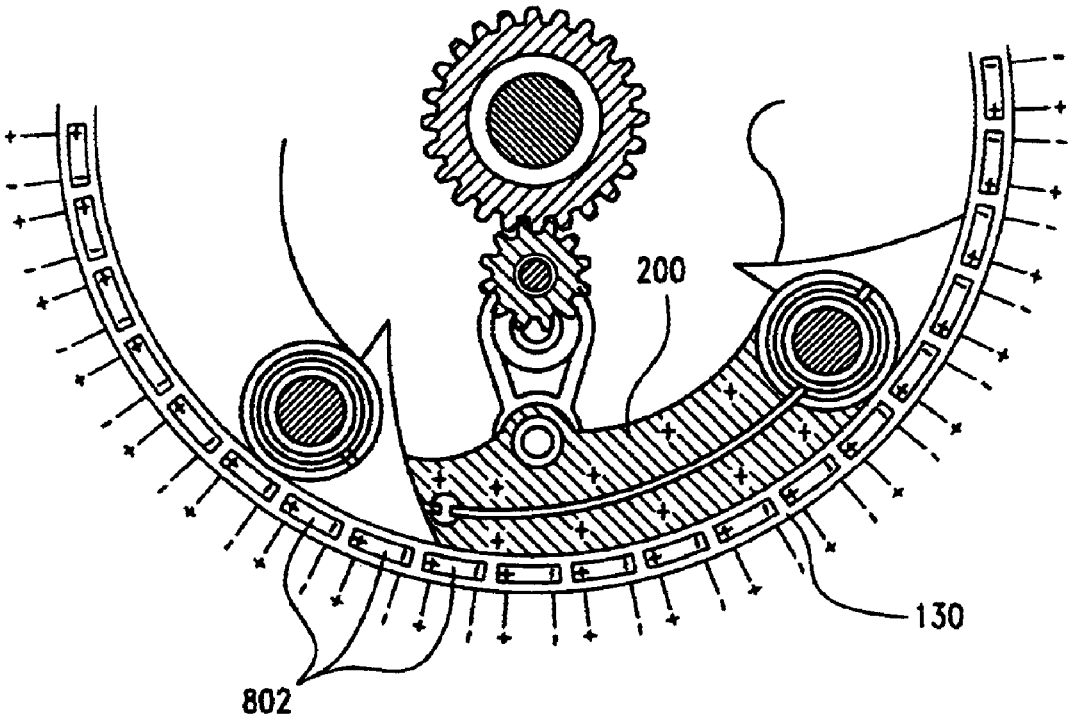
FIG. 8 shows a curved rectangular and magnetized piston blade with the same polarity as the stator.

FIG. 8 shows a fin 200 magnetized with positive and negative charges and a stator 130 having a series of independent electromagnets 802 magnetically energized, either positively or negatively for the purposes of repelling or attracting in relation to the necessary position of the fin 200. Additionally, negative or positive charges may be concurrently activated to quickly brake the rotor 128, all this based on the magnetic principle that same charges are repelled and contrary charges attracted.

Figure 9:
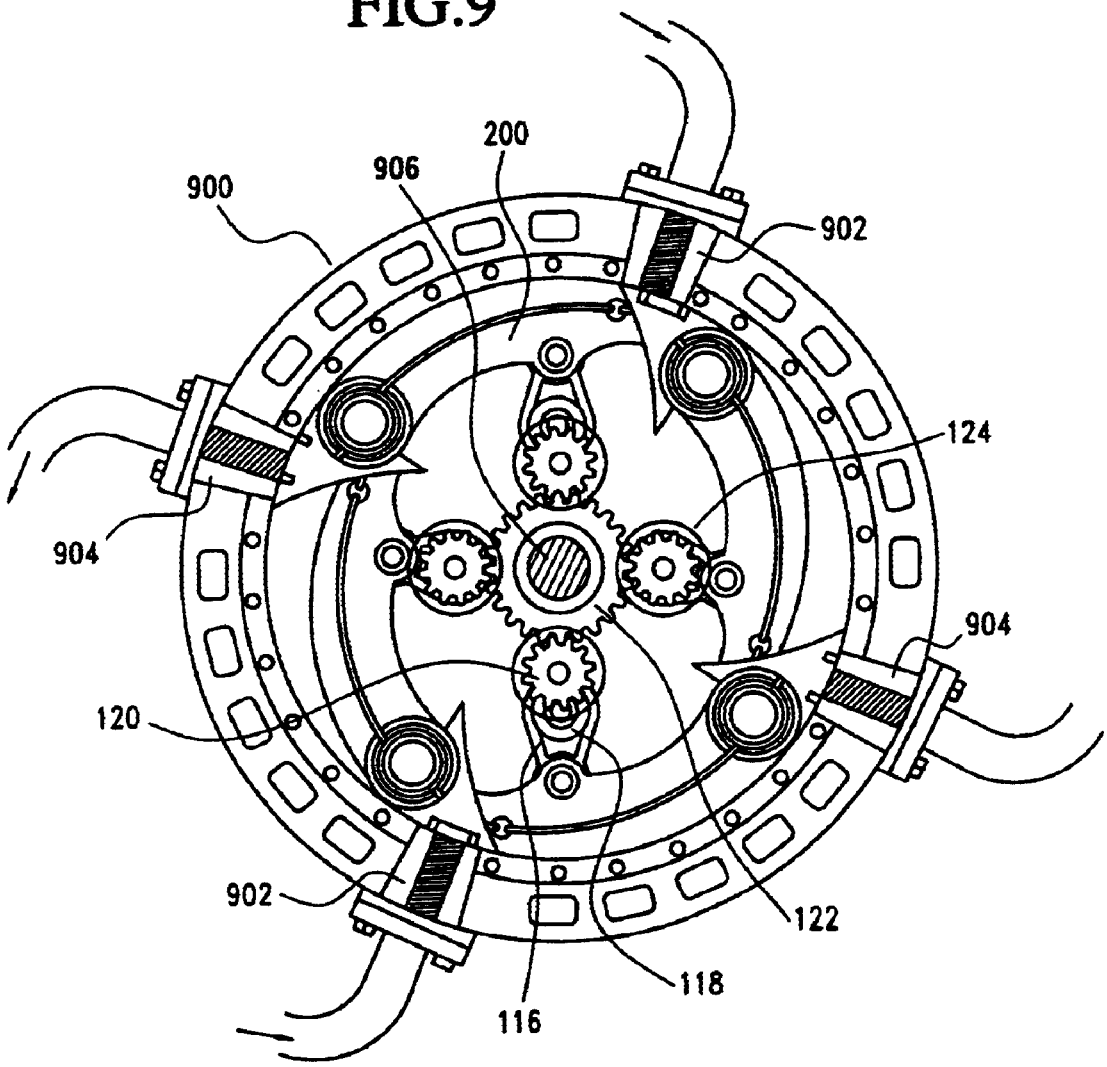
FIG. 9 shows a schematic side view of a compressor or rotatory vacuum pump type rotary internal combustion engine where piston blades replace pistons in the traditional compressor (Otto system), and is driven by means of its shaft.

FIG. 9 shows a compressor and/or vacuum pump type rotary internal combustion engine 900 where piston blades 200 perform two expansion cycles 902 and two contraction cycles 904. Such piston blades 200 are transported due to torsion resulting from a power plant taking the power from the central shaft 906, pushing the crankshafts 118, putting into motion the connecting rods 116 due to pinion 120 motion of the crankshaft 118 which are moved through bearings 124, which when displaced due to torsion actuates the central shaft 906 rotating the pinions 120 when supported by the fixed pinions 122 rotating twice per turn. In the entrances of expansion 902 and contraction 904 are located valves, such as check valves that allow for ingress and egress of air.

What is claimed is:

1. A rotary internal combustion engine, comprising:

at least four piston blades;

each of said piston blades having a toothed moving pinion connected thereto;

a toothed fixed pinion geared to said toothed moving pinions;

and electromagnetically responsive piston blades;

wherein the gear ratio of the toothed fixed pinion to the toothed moving pinions are one half the number of piston blades to one.

2. The rotary internal combustion engine of claim 1, further comprising an electromagnetic stator.

3. An electromagnetic rotary engine, comprising:

at least two electromagnetically responsive piston blades;

each of said piston blades having a toothed moving pinion connected thereto;

a toothed fixed pinion geared to said toothed moving pinions; and an electromagnetic stator.

4. The electromagnetic rotary engine of claim 3, wherein there are four piston blades.

5. The electromagnetic rotary engine of claim 3, wherein there are six piston blades.

6. The electromagnetic rotary engine of claim 3, wherein there are eight piston blades.

7. The electromagnetic rotary engine of claim 3, wherein there are ten piston blades.

8. The electromagnetic rotary engine of claim 3, wherein there are twelve piston blades.

9. The electromagnetic rotary engine of claim 3, wherein negative or positive charges of said stator is concurrently activated to brake said piston blades.

10. An rotary internal combustion engine, comprising:

at least four electromagnetically responsive piston blades;

each of said piston blades having a toothed moving pinion connected thereto;

a toothed fixed pinion geared to said toothed moving pinions; and an electromagnetic stator.

11. The rotary internal combustion engine of claim 10, wherein there are eight piston blades.

12. The rotary internal combustion engine of claim 10, wherein there arc twelve piston blades.

13. The rotary internal combustion engine of claim 10, wherein said toothed fixed pinion is a central gear.

14. The rotary internal combustion engine of claim 10, wherein said toothed fixed pinion is a fixed internally-toothed ring.

* * * * *